US005246411A

United States Patent [19]

Rackman et al.

[11] Patent Number: 5,246,411

[45] Date of Patent: Sep. 21, 1993

[54] EXERCISE MACHINE SYSTEM

[76] Inventors: Michael I. Rackman, 1710 Glenwood Rd., Brooklyn, N.Y. 11230; Fred Milstein, 456 Braemar Ranch La., Santa Barbara, Calif. 93109

[21] Appl. No.: 638,181

[22] Filed: Jan. 4, 1991

[51] Int. Cl.[5] ..... A63B 69/00

[52] U.S. Cl. ..... 482/57; 482/902

[58] Field of Search ..... 273/436, DIG. 28, 148 B; 272/73, 129, 130, 69, 72; 434/307-313; 73/379; 482/1-9, 57, 51, 900, 902

[56] References Cited

U.S. PATENT DOCUMENTS 4,298,893 11/1981 Holmes ..... 272/73
4,443,008 4/1984 Shimano ..... 272/73
4,512,566 4/1985 Bicocchi ..... 482/2
4,637,605 1/1987 Ritchie ..... 272/73
4,839,743 6/1989 Best et al. ..... 434/308 X
4,911,427 3/1990 Matsumoto et al. ..... 482/900 X
4,925,189 5/1990 Braeunig ..... 273/148

*Primary Examiner*—Richard J. Apley
*Assistant Examiner*—Glenn E. Richman
*Attorney, Agent, or Firm*—Gottlieb, Rackman & Reisman

[57] ABSTRACT

An exercise system and method for insuring that a user exercises at a level at or above a preset level. The user exercises in front of TV. Noise is mixed with the TV signal if the exercise level drops below the preset level. The result is instantaneous biofeedback and maintenance of the desired exercise level.

6 Claims, 2 Drawing Sheets

EXERCISE MACHINE SYSTEM

This invention relates to exercise machines, and more particularly to an apparatus and method for helping to insure that a person using the machine exercises at or above a preset level.

There are many kinds of exercise machines, stationary bicycles being illustrative. Many such machines are provided with displays which provide the user with all kinds of information— the elapsed time, the desired exercise level, the actual exercise level, etc. Typical of such patents is U.S. Pat. No. 4,443,008. It is also commonplace to provide a blinking light or similar warning indication when the actual exercise level, e.g., speed, is less than the preset level.

There are other exercise systems which are combined with television displays, e.g., that disclosed in U.S. Pat. No. 4,925,189 in which the actual display is a function of movement by the user. Perhaps the prior art which is most pertinent to the subject invention is that disclosed in U.S. Pat. No. 4,637,605. There, the user of an exercise machine plays a video game while he is exercising, but the controls are operational only if the degree of exercise exceeds a preset level; the video signal is also said to "weaken" if the exercise level is too high or too low. Unfortunately, such an arrangement relieves the boredom of exercise only for those who enjoy video games, thus having little utility for most of the population. Most users of stationary exercise bicycles, for example, simply watch TV or listen to music or the radio, without there being a way to promote exercise at or above the preset level.

It is an object of our invention to provide a simple mechanism for insuring that the user of an exercise machine exercises at or above a preset level.

Although disclosed in the context of a TV and video cassette recorder, our invention is equally applicable to other entertainment systems, for example, radios and ordinary TV viewing (without a VCR). In its simplest form, the entertainment program is not "clear" if the level of exercise is below the preset value. In the case of a television, for example, a noise generator can feed the TV input, together with programming from a VCR, so that there are annoying streaks on the display if the cyclist does not maintain the desired speed; the streaks can be similar to those produced by a VCR which is tracking improperly. All that is required is to compare the instantaneous speed with the preset level, and to turn on the noise generator if the exercise level is too low. The user reaction to this biofeedback is almost instantaneous—a speed-up in exercise level as soon as there is visual interference with the TV picture. In the case of a radio, static could be generated and mixed with the audio program.

In a more sophisticated form of the invention, two videotapes could be played simultaneously on two video cassette recorders. One of the programs could be "more interesting", than the other. For example, one program might be a feature movie, and the other might be a children's cartoon. The more interesting program would be displayed on the TV only if the preset level is exceeded; otherwise the user must endure watching the cartoon. (For those users of exercise machines who enjoy watching pornographic films while exercising, it is apparent that the two videotapes might be rated respectively "X" and "R", with the more energetic cyclist being "rewarded" with the more energetic feature.)

What is common to all embodiments of the invention is that the entertainment program is user-independent in the sense that the content, when the preset exercise level is exceeded, is not determined by the user who simply watches and/or listens.

Further objects, features and advantages of our invention will become apparent upon consideration of the following detailed description in conjunction with the drawing, in which.

Figure 1:
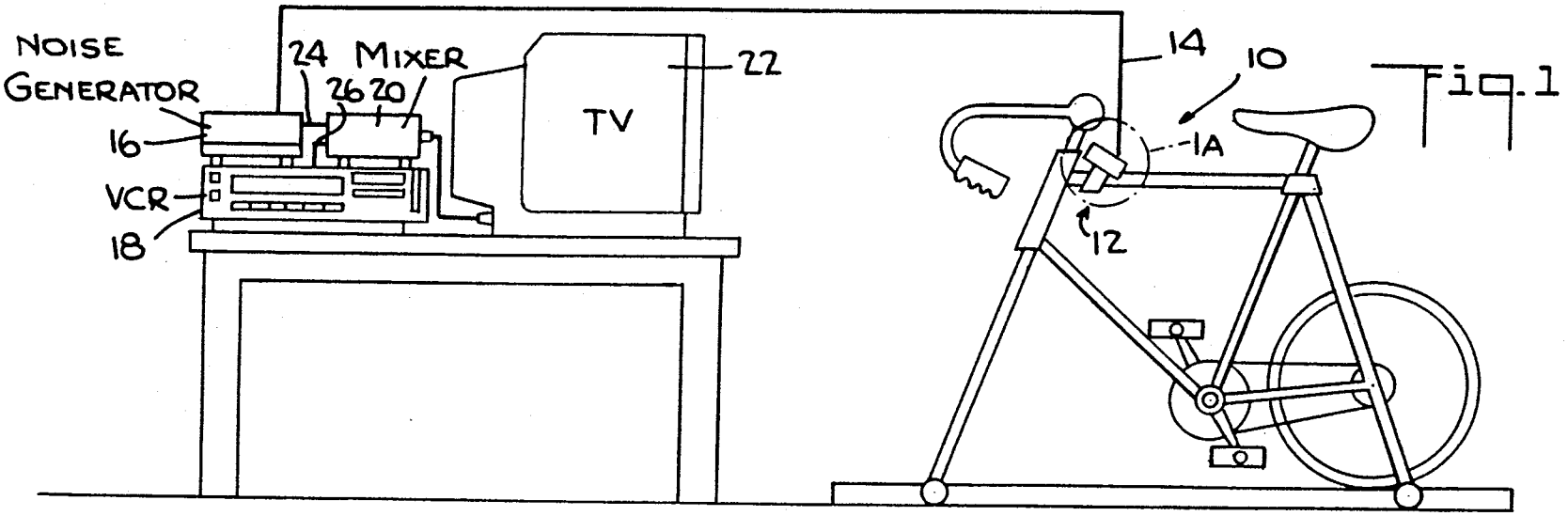
FIG. 1 depicts a first illustrative embodiment of our invention.
Figure 1A:
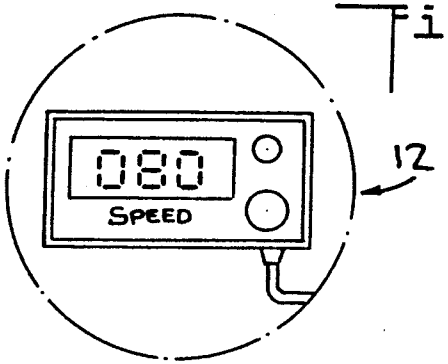
FIG. 1A is an enlarged detail view of a part of the structure shown in the broken-line circled region of FIG. 1.
Figure 2:
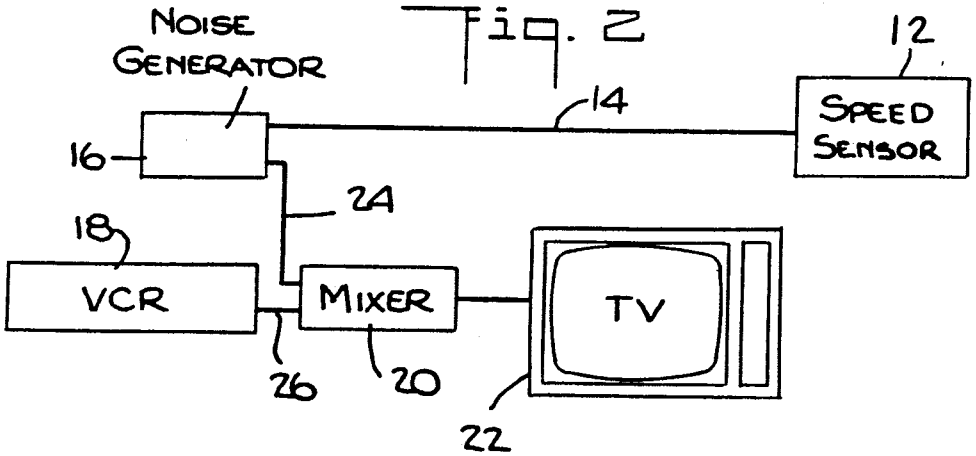
FIG. 2 is a schematic of the circuit blocks included in the system of FIG. 1.

Referring to FIG. 1, a conventional exercise machine is shown by the numeral 10. The numeral 12 represents a speed sensor, also shown in part in a blow-up in FIG. 1A framed by the dashed lines. The output of the speed sensor is a signal which is extended over cable 14 to noise generator 16, seen most clearly in FIG. 2. The noise generator is turned on if the output of the speed sensor indicates that the pedal speed is below the preset speed, for example, 80 rpm. If the pedal speed is above the preset speed, the noise generator is turned off.

The output of the noise generator is extended over cable 24 to one input of mixer 20. The output of VCR 18 is extended over cable 26 to the second input of mixer 20. The mixer mixes the two signals and extends them to the input of TV receiver 22.

It is apparent that as long as the cyclist exercises at a level which exceeds the preset level (which preset level can be keyed in, although not shown in the drawing), he is able to view the programming material in an undistorted form. But as soon as his speed drops below the preset level, the programming material has noise added to it. It is possible to vary the degree of the noise with how far the actual pedal speed differs from the desired speed, but an on/off control is adequate to promptly get the cyclist back to speed.

One advantage of using a noise generator and a mixer, instead of perhaps controlling turn-off of the programming material altogether, is that a return to the desired display can be much more rapid. This is also true in the case of variable noise referred to above, where the cyclist is not "punished" as much for falling only slightly below the preset level as he is for falling far below it. Were the TV or the VCR to be turned off, it would take several seconds for it to be turned on once again. The noise generator, on the other hand, can be turned off instantaneously.

Figure 3:
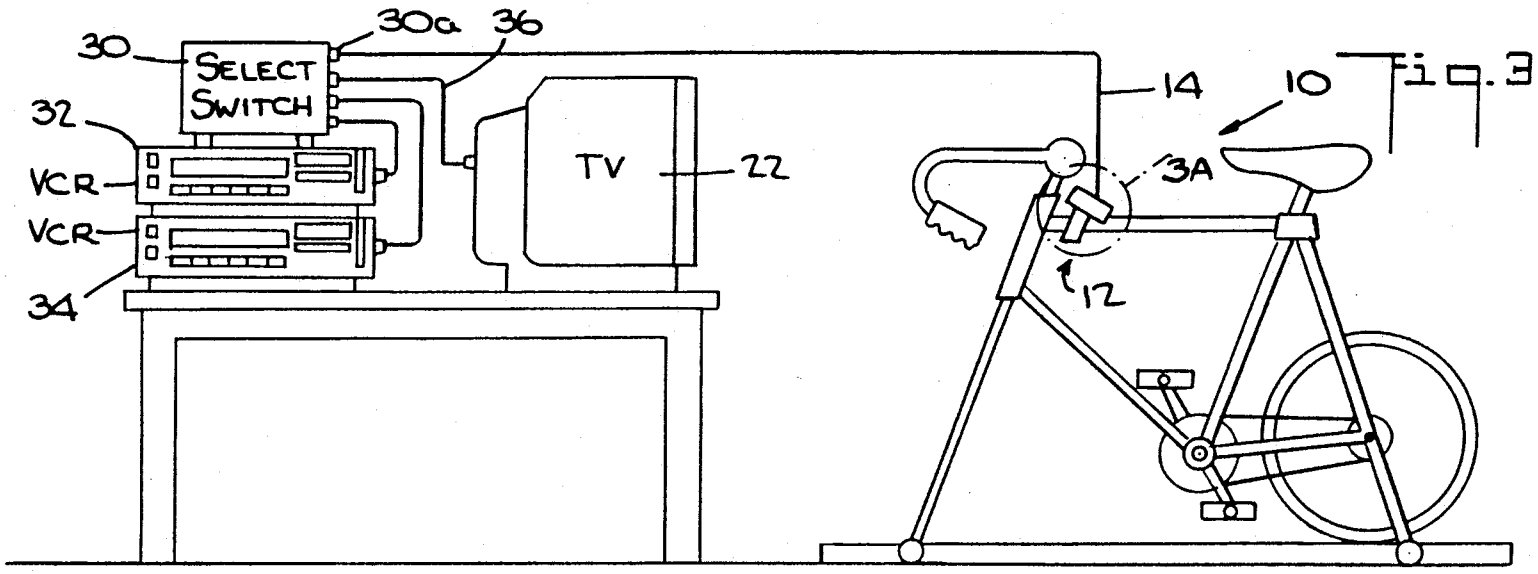
FIG. 3 depicts a second illustrative embodiment of our invention.
Figure 3A:
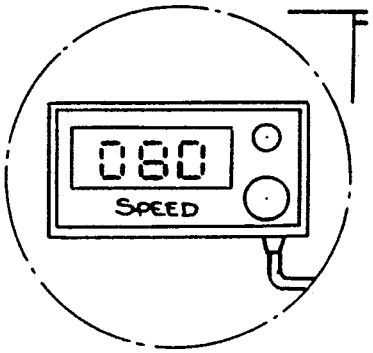
FIG. 3A is an enlarged detail view of a part of the structure shown in the broken-line circled region 3A of FIG. 3.
Figure 4:
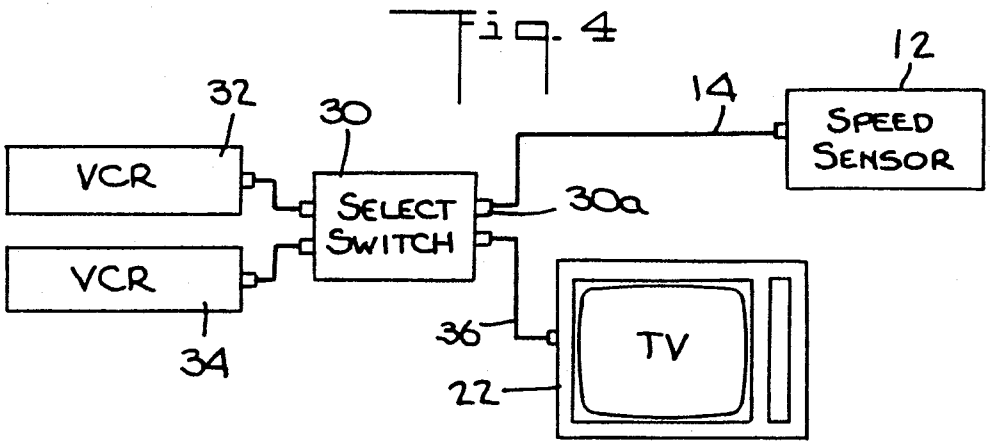
FIG. 4 is a schematic of the circuit blocks included in the system of FIG. 3.

In the system of FIG. 3, the arrangement is slightly different. Here the output on cable 14 is used not as an on/off control, but rather as a control for switch 30, although the speed sensor 12, a part of which is again shown in a blow-up in FIG. 3A, remains the same. There are two VCRs 32 34 stacked one on top of the other on a table. The outputs of the two VCRs are connected to two inputs of switch 30. The control cable 14 is connected to the select input 30*a* of switch 30.

Depending on the state of the signal on cable 14, one or the other of the two inputs is connected to the output, the output of the switch being connected over cable 36 to TV 22. Thus depending on whether the cyclist is exercising above or below the preset level, the state of the signal on cable 14 causes one or the other of the two video programs to be displayed on the TV.

The difference between the two illustrative systems is that while in one there is only one source of entertainment to which "interference" is added, in the other there are two separate entertainment sources, one of which is selected. What is common to both is that the user experiences a user-independent entertainment program in a preferred form only if he maintains the preset exercise level.

Although the invention has been described with reference to particular embodiments, it is to be understood that these embodiments are merely illustrative of the application of the principles of the invention. For example, it is possible to provide a multi-track tape in a single VCR with the track selected for play being a function of the exercise level. Thus numerous modifications may be made in the illustrative embodiments of the invention and other arrangements may be devised without departing from the spirit and scope of the invention.

What is claimed is:

1. A system for prompting the user of an exercise machine to exercise at or above a preset level comprising means operative independent of the user's exercise level for providing a user-independent entertainment program, means for sensing the user's exercise level to determine if it is below said preset level, and means operatively coupled to said sensing means controlling said entertainment program to be played in a preferred form only if said sensing means determines that the user is exercising at or above said preset level.

2. A system in accordance with claim 1 wherein said entertainment program is a television display, and said controlling means interferes with the display if said sensing means determines that the user is not exercising at or above said preset level.

3. A system in accordance with claim 1 wherein said providing means provides two separate user-independent television signals, and said controlling means causes the preferred one of said two signals to be displayed only if said sensing means determines that the user is exercising at or above said preset level.

4. A method from prompting the user of an exercise machine to exercise at or above a preset level comprising the steps of providing independent of the user's exercise level a user-independent entertainment program, sensing the user's exercise level to determine if it is below said preset level, and in response to said sensing step, controlling said entertainment program to be played in a preferred form only if in said sensing step it is determined that the user is exercising at or above said preset level.

5. A method in accordance with claim 4 wherein said entertainment program is a television display, and said controlling step interferes with the display if in said sensing step it is determined that the user is not exercising at or above said preset level.

6. A method in accordance with claim 4 wherein two separate user-independent television signals are provided, and said controlling step causes the preferred one of said two signals to be displayed only if in said sensing step it is determined that the user is exercising at or above said preset level.

* * * * *